US009090268B2

(12) United States Patent
Bohme

(10) Patent No.: US 9,090,268 B2
(45) Date of Patent: Jul. 28, 2015

(54) POINT LUG AND RAIL MOUNT CONNECTIONS FOR A RAILROAD POINT MACHINE APPARATUS

(71) Applicant: Siemens Industry, Inc., Alpharetta, GA (US)

(72) Inventor: Richard C. Bohme, Louisville, KY (US)

(73) Assignee: Siemens Industry, Inc., Alpharetta, GA (US)

( * ) Notice: Subject to any disclaimer, the term of this patent is extended or adjusted under 35 U.S.C. 154(b) by 120 days.

(21) Appl. No.: 13/865,716

(22) Filed: Apr. 18, 2013

(65) Prior Publication Data

US 2014/0312180 A1 Oct. 23, 2014

(51) Int. Cl.
*E01B 7/02* (2006.01)
*B61L 5/02* (2006.01)

(52) U.S. Cl.
CPC .. *B61L 5/026* (2013.01); *E01B 7/02* (2013.01)

(58) Field of Classification Search
USPC ..... 246/415 R, 416, 430, 435 R, 438, 439, 246/448, 449, 452
See application file for complete search history.

(56) References Cited

U.S. PATENT DOCUMENTS

| | | | | |
|---|---|---|---|---|
| 5,730,395 | A * | 3/1998 | Carmes | 246/448 |
| 6,158,698 | A * | 12/2000 | Click et al. | 246/449 |
| 2004/0227037 | A1* | 11/2004 | Schwiede et al. | 246/415 R |
| 2005/0139729 | A1* | 6/2005 | Klein | 246/415 R |
| 2011/0155864 | A1* | 6/2011 | Wolf et al. | 246/393 |

* cited by examiner

*Primary Examiner* — R. J. McCarry, Jr.

(57) ABSTRACT

New and improved point machine, point lug and rail mount connections for a railroad point machine apparatus. The new point machine and point lug connections overcome the problems associated with point run, lift and bounce of a point rail. Moreover, the rail mount provides for a generic, common platform that can be used with different sized stock rails.

22 Claims, 9 Drawing Sheets

POINT LUG AND RAIL MOUNT CONNECTIONS FOR A RAILROAD POINT MACHINE APPARATUS

FIELD OF THE INVENTION

Embodiments of the invention relate to railroad switch equipment and, more particularly, to point machine, point lug and rail mount connections for a railroad point machine apparatus.

BACKGROUND

It is generally understood that a railroad switch apparatus is used to switch a train from a first set of railroad tracks to a second set of railroad tracks. The typical railroad switch apparatus includes a pair of movable rails and a switch machine or hand throw machine for moving the movable rails. These movable rails are also known as point rails. The railroad switch apparatus will also include assorted connective hardware that extends between the movable rails and the switch machine for various purposes. As is known in the art, the switch machine/hand throw machine provides the forces necessary to move the point rails between a first position and a second position and to lock the rails in the one of the positions. For example, when the point rails are in the first position, a first point rail will contact/engage a first stock rail such that a train travelling along the railroad tracks will remain on a first set of rails. However, when the point rails are in the second position, a second point rail will contact/engage a second stock rail such that a train travelling along the railroad tracks will switch to a second set of rails.

As is also known in the art, a detection apparatus detects the position of the movable rails with respect to the first and second stock rails to determine whether or not the movable rails are correctly positioned. The detection apparatus, also known as a point machine, is connected to, and follows the movement of, the point rails and contains switches and other components that detect the position of the rails. If the point machine detects that the appropriate point rail does not become engaged with or is spaced too far away from its corresponding stock rail, the point machine provides an indication that the tracks are unsafe and that trains should not pass over the switching point.

In operation, the point rails are pivoted along an arc. As such, they tend to lift when being moved. Moreover, trains travelling on the rails may cause the rails to bounce. In addition, point rails are subject to thermal expansion and contraction, often referred to as point run. Point lift, bounce and run can cause a shaft connecting the point machine to the point rails to bind or become damaged, rendering the point machine ineffective for its intended purpose. Thus, the installed equipment must account for point rail lift, bounce and run to prevent damage to the point machine connections to the point rails and the mechanisms within the point machine.

Typically, this means that the connections from the point machine will include drop down logs, balls, swivels and rods that are routed under the machine and at least one stock rail and then routed up to the shaft connection to a point rail. Due to the large number of required parts, setting up and aligning the connections will require substantial man power and can be time consuming. Moreover, the equipment will be costly, heavy and complex and will be difficult to adjust once installed. Thus, there is a need and desire for simple, yet robust point machine connections to point rails that overcomes the problems associated with point lift, bounce and run.

It is also known that point machines are mounted to or near at least one stock rail and that stock rails come in different sizes. This means that specific, dedicated point machine hardware is required to connect a point machine to or near the differently sized rails, which is undesirable. Thus, it would be desirable to have common point machine hardware that can be used to interface a point machine with different sized stock rails.

SUMMARY

Embodiments disclosed herein provide new and improved point machine, point lug and rail mount connections for railroad point machine apparatuses. The new point machine and point lug connections overcome the problems associated with point run, lift and bounce of a point rail. Moreover, the rail mount provides for a generic, common platform that can be used with different sized stock rails.

Further areas of applicability of the present disclosure will become apparent from the detailed description, drawings and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Figure 1:
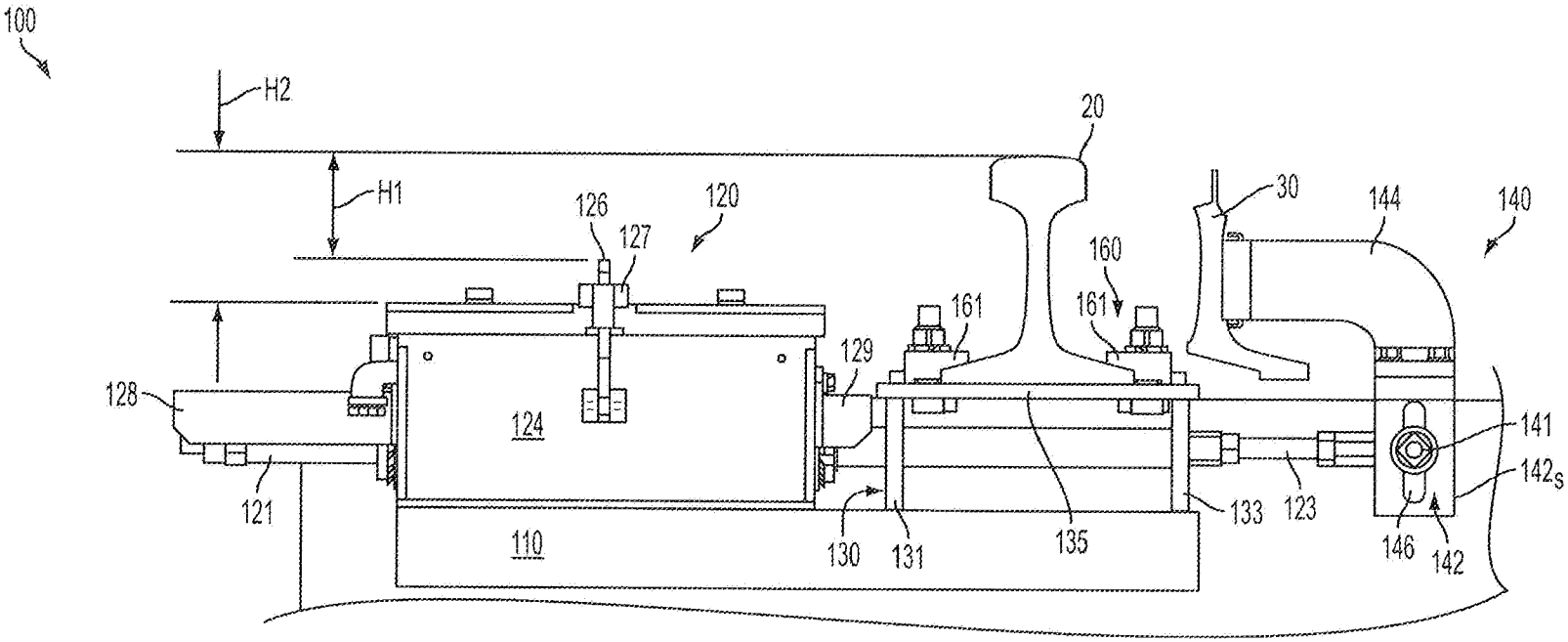
FIG. 1 illustrates a side view of a point machine apparatus constructed in accordance with an embodiment disclosed herein.
Figure 2:
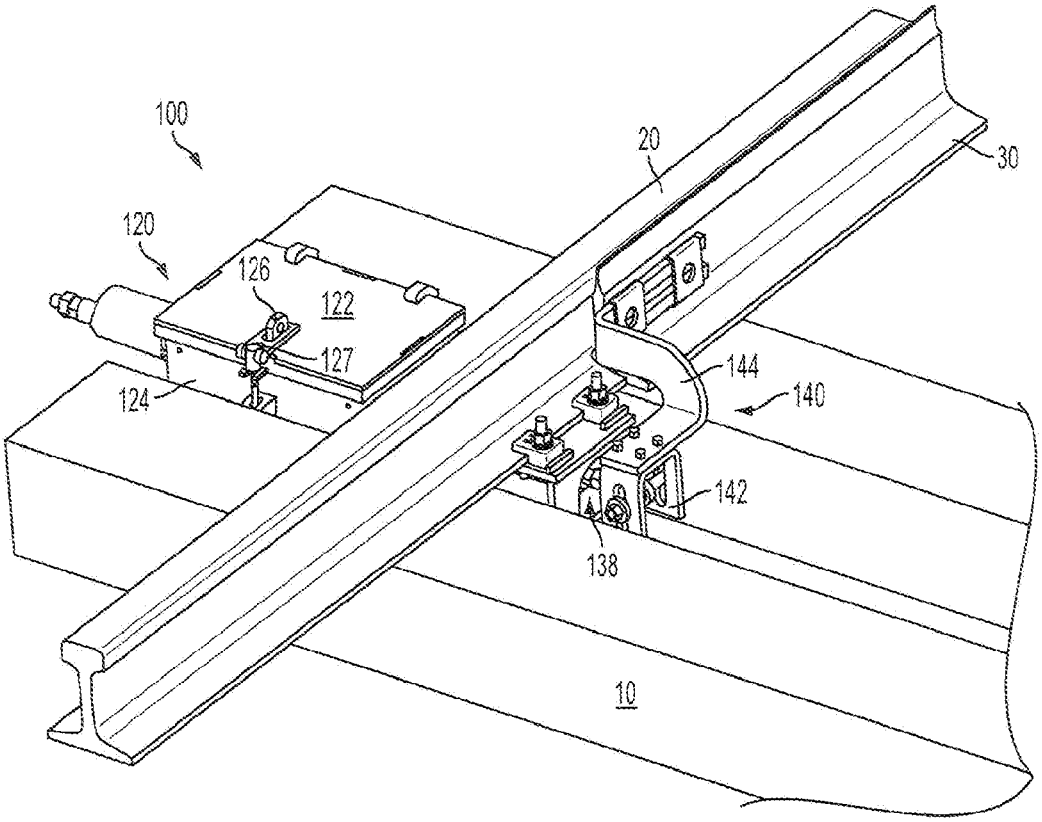
FIG. 2 illustrates a perspective view of a portion of the FIG. 1 point machine apparatus.
Figure 3:
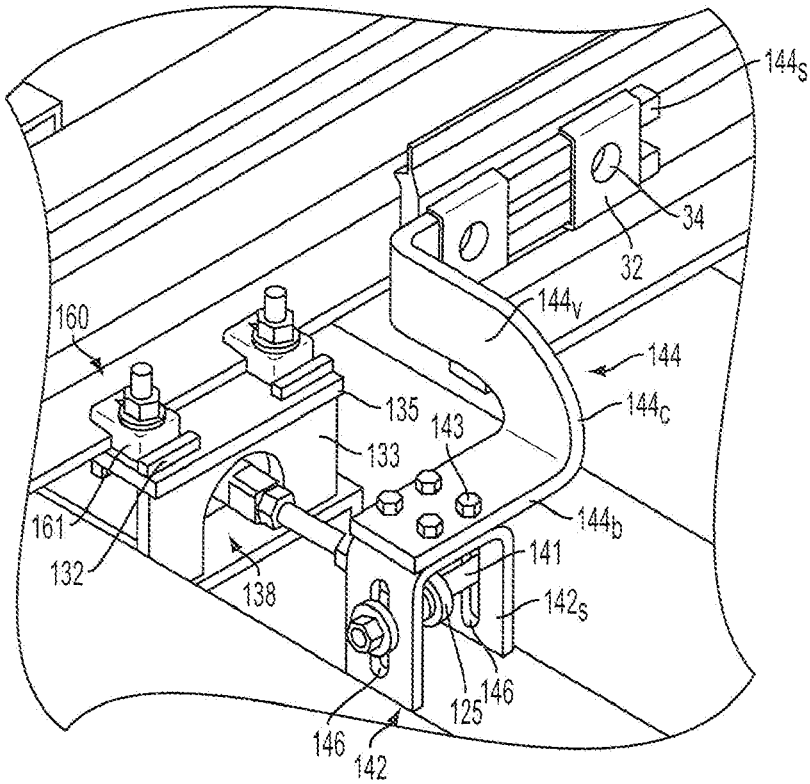
FIG. 3 is another perspective view of a portion of the FIG. 1 point machine apparatus.
Figure 5:
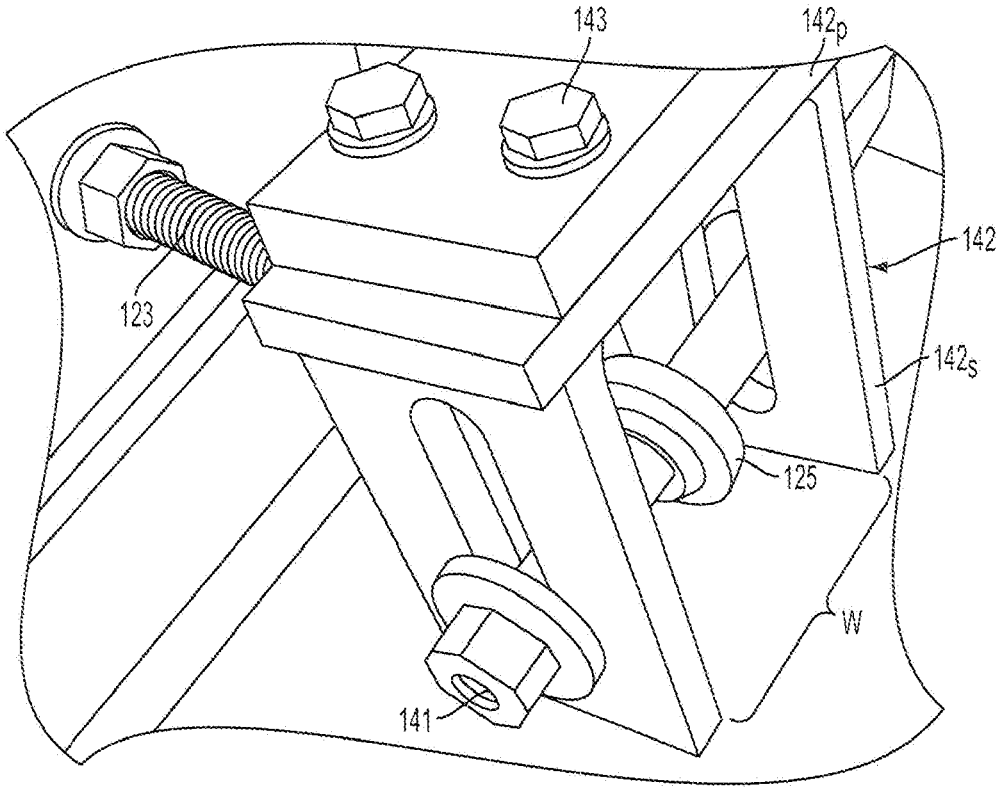
FIG. 5 illustrates further details of the point rail connection assembly constructed in accordance with an embodiment disclosed herein.
Figure 6:
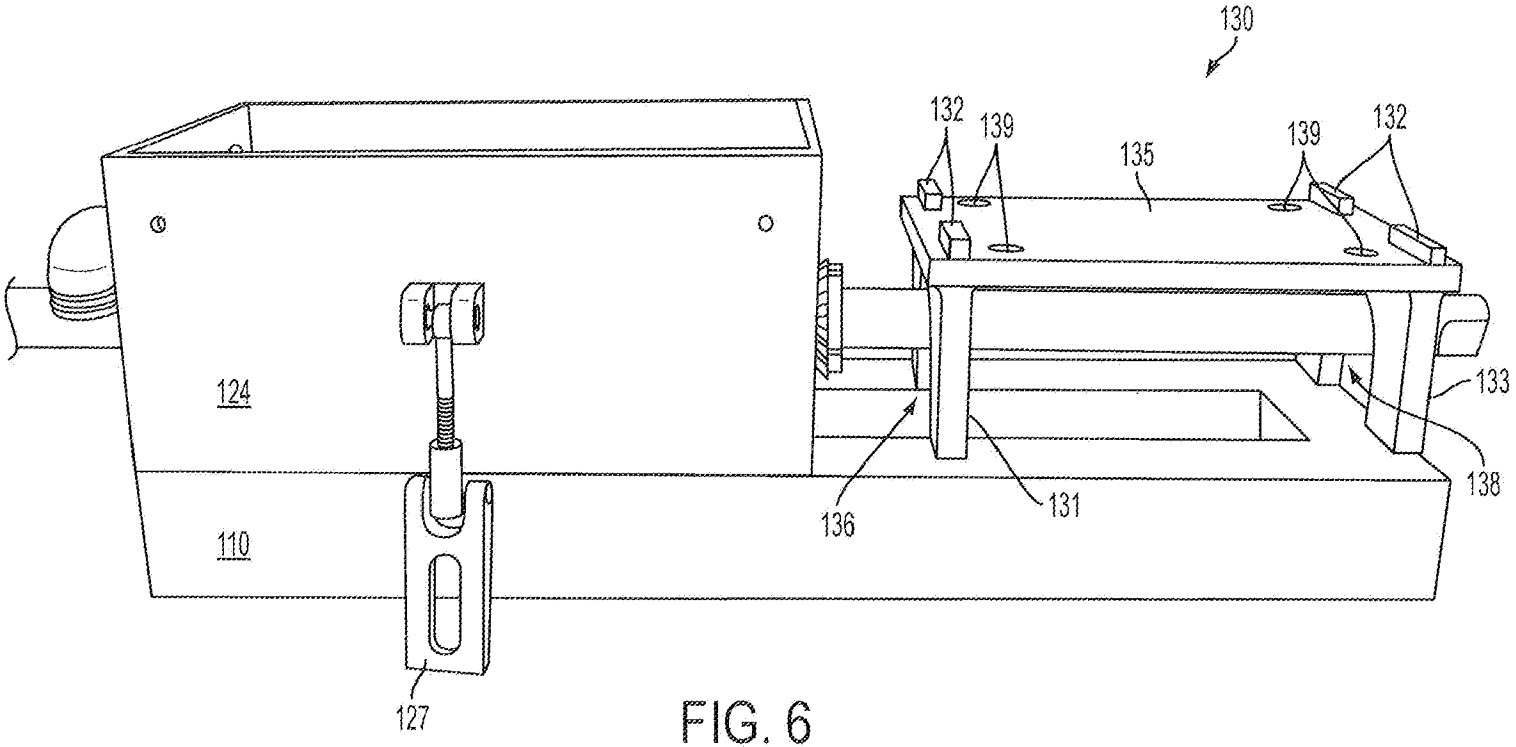
FIG. 6 is a side view of a point machine and stock rail mount connected to a base in accordance with an embodiment disclosed herein.
Figure 7:
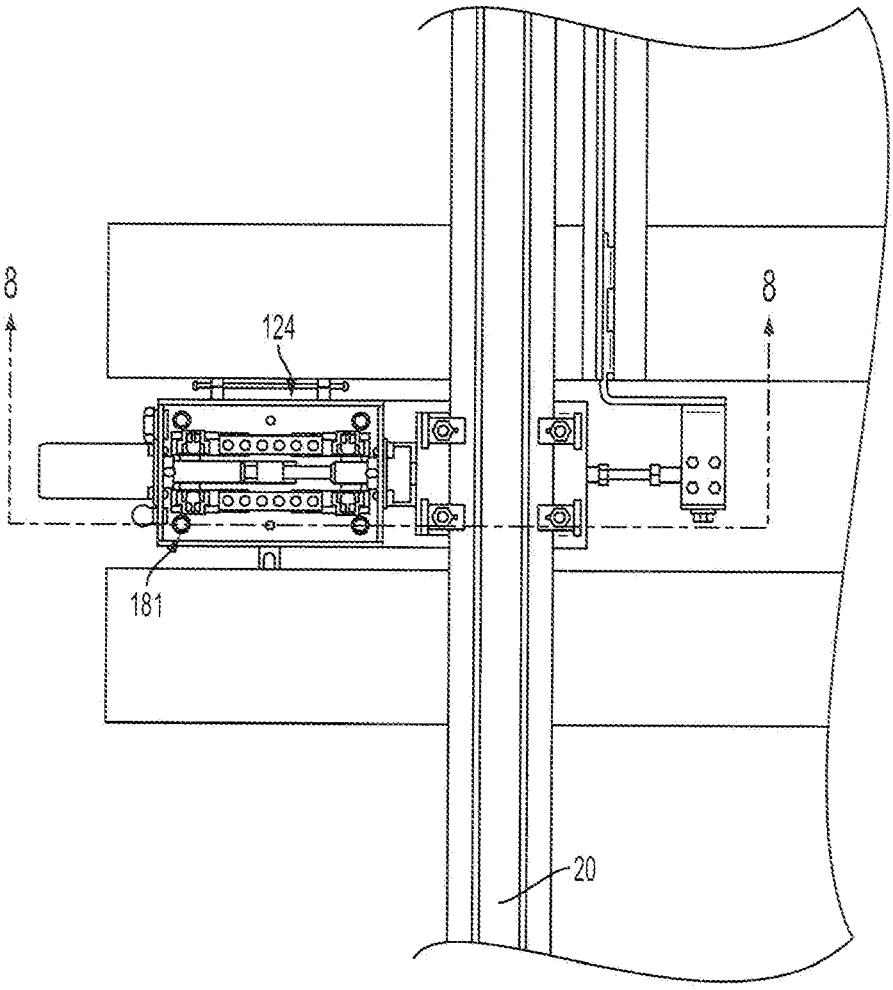
FIG. 7 is a top view of a point machine apparatus constructed in accordance with an embodiment disclosed herein wherein the cover of the point machine is removed.
Figure 8:
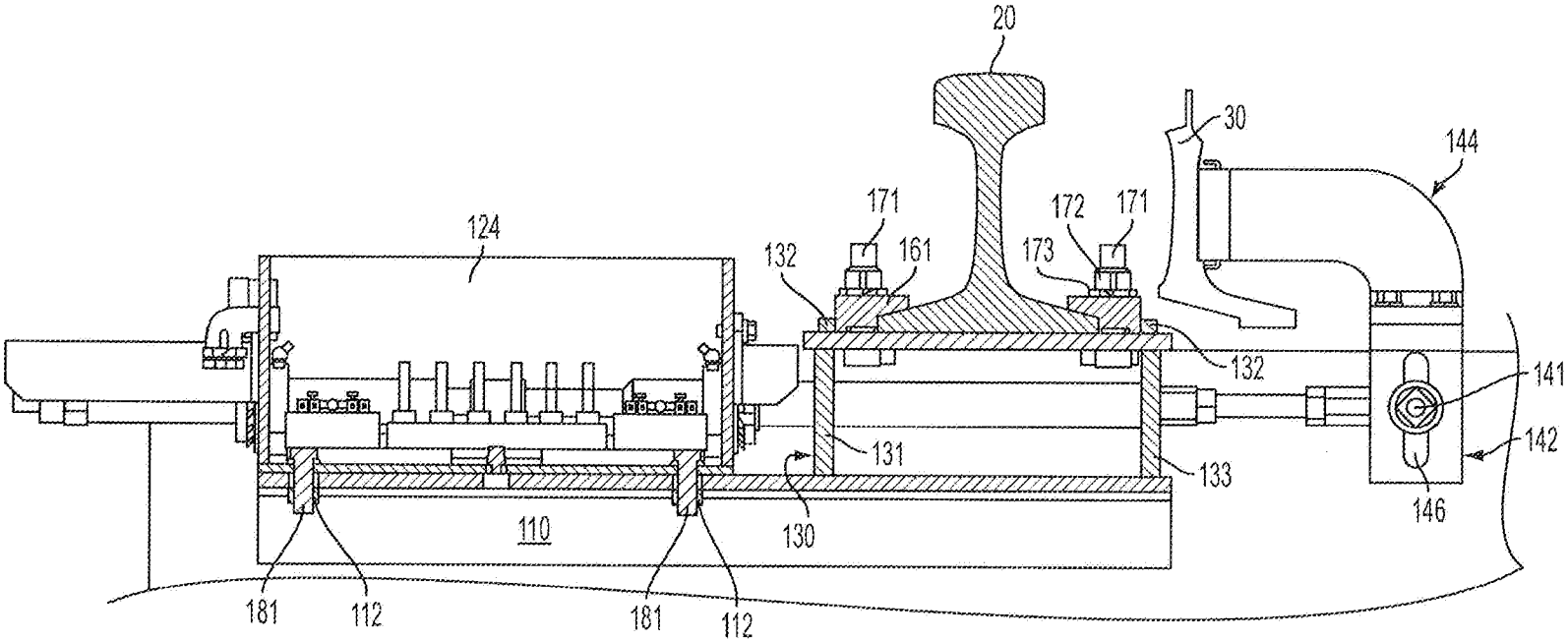
FIG. 8 is a partial cross sectional view of the point machine apparatus of FIG. 7 taken along line 8-8.
Figure 9:
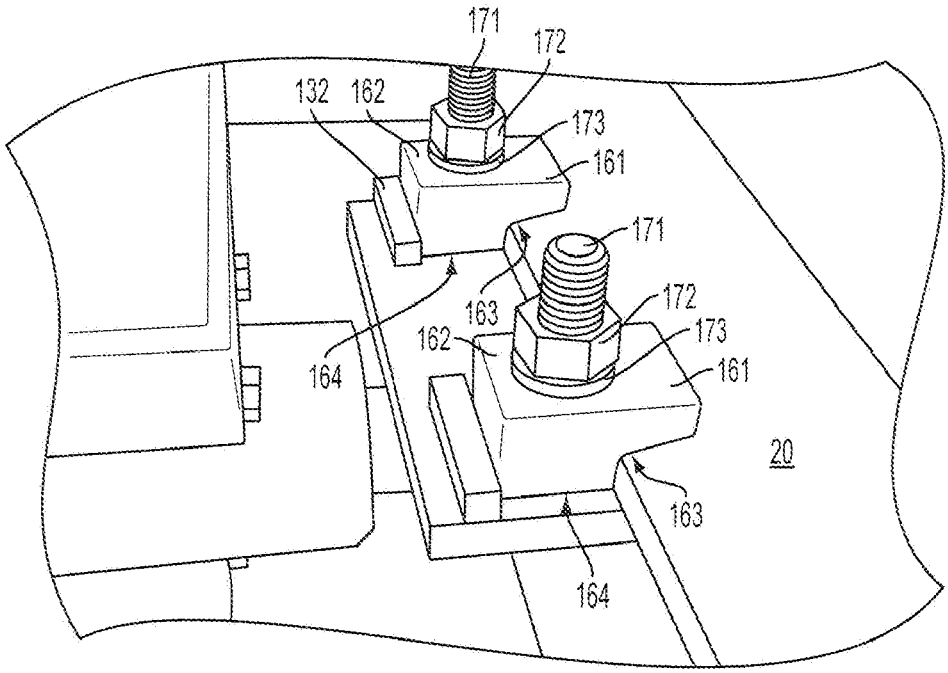
FIG. 9 illustrates details of the stock rail connection assembly and the stock rail mount constructed in accordance with an embodiment disclosed herein.

FIGS. 1-9 illustrate a point machine apparatus 100 constructed in accordance with the disclosed principles. As shown in FIG. 1, the apparatus 100 comprises a point machine 120, stock rail mount 130, point rail connection assembly 140 and a stock rail connection assembly 160. As is discussed below in more detail, a stock rail 20 is connected to the stock rail mount 130 via the stock rail connection assembly 160 and a movable point rail 30 is connected to the point machine 120 via the point rail connection assembly 140. FIGS. 1, 7 and 8 show the point rail 30 positioned away from the stock rail 20 while FIGS. 2 and 3 show the point rail 30 in contact with the stock rail 20. As shown in FIG. 2, the stock rail 20 is connected across a plurality of railroad ties 10. It should be appreciated that tie plates and spikes used to connect the stock rail 20 to the railroad ties 10 are not shown to prevent cluttering of the Figures. It should also be appreciated that the Figures do not illustrate the second stock and point rails that would also be required for proper railroad operation.

The point machine 120 comprises a housing 124 and a cover 122 (best seen in FIG. 2). A lug 126 having a hole for receiving a locking mechanism such as e.g., a pad lock (not shown) is attached to the cover 122. A latch 127 is hinged and connected to the external portion of the housing 124 and is adapted to swing over the lug 126. A hole in the latch 127 exposes the lug 126 and its hole, which allows track and/or maintenance personnel to place a locking mechanism through the hole in the lug 126 and lock the point machine 120. Protective coverings 128, 129 extend from the point machine housing 124 to respectively protect the point machine's 120 indicator rod 121 and adjustment rod 123. It should be appreciated that rod 121 can be a two piece rod that is adjustable in length to vary the chamfer distance that would activate the switches in the point machine 120.

Key aspects of the disclosed embodiments include the point rail connection assembly 140 and the connection between the point machine 120 and the point rail connection assembly 140. Specifically, the point rail connection assembly 140 disclosed herein and its connection between the point machine 120 and the movable point rail 30 will overcome the potential problems associated with point run, lift and bounce.

The point rail connection assembly 140 comprises a yoke 142 connected to the adjustment rod 123 and a point lug assembly 144 connected between the yoke 142 and the point rail 30. In a desired embodiment, the yoke 142 is made of steel. As can be appreciated, the adjustment rod 123 is threaded so that its length can be adjusted for a better connection to and operation with the yoke 142. In one embodiment, the yoke 142 is illustrated as having an inverted U-shaped body (shown in FIGS. 2 and 3) formed from a continuous piece of metal. In another embodiment (shown in FIGS. 4 and 5), the yoke 142 is illustrated as having two side walls $\mathbf{142}_s$ welded to a top $\mathbf{142}_p$ and forming an inverted U-shape body similar to the yoke 142 illustrated in FIGS. 2 and 3. Besides the manner in which the yoke 142 is constructed (i.e., one piece or multiple pieces of metal), there are no differences between the two embodiments; as such, they will be discussed together and referred to herein as "yoke 142" having an inverted U-shape with sides $\mathbf{142}_s$ and a top $\mathbf{142}_p$.

The sides $\mathbf{142}_s$ of the yoke 142 each comprise a longitudinal slot 146. The slots 146 are sized to allow a bolt 141 to pass there-through. As can be seen in FIG. 5, the bolt 141 is passed through a slot 146 in a first side $\mathbf{142}_s$, through an eye hole of a swivel eye component 125 connected to the adjustment bar 123, and out through a slot 146 in the second side $\mathbf{142}_s$ of the yoke 142. One or more nuts and washers (not shown) can be used, for example, to retain the bolt 141 in position. As such, the swivel eye component 125 is transversely connected between the sides $\mathbf{142}_s$ of the yoke 142. In one embodiment, two nuts are used, one on each end of the bolt 141. The nuts can have a flange, with the yoke-side of the flange having a generous radius to prevent a sharp corner or edge from digging in and binding during rail point bounce. In accordance with the disclosed principles, the width W between the sides $\mathbf{142}_s$ of the yoke 142 provides room for the swivel eye component 125 to slide along the bolt 141 in the horizontal direction if the point rail 30 undergoes point run. These adjustments will keep the rods of the point machine 120 from binding due to point run (i.e., thermal expansion of the point rail 30).

Figure 4:
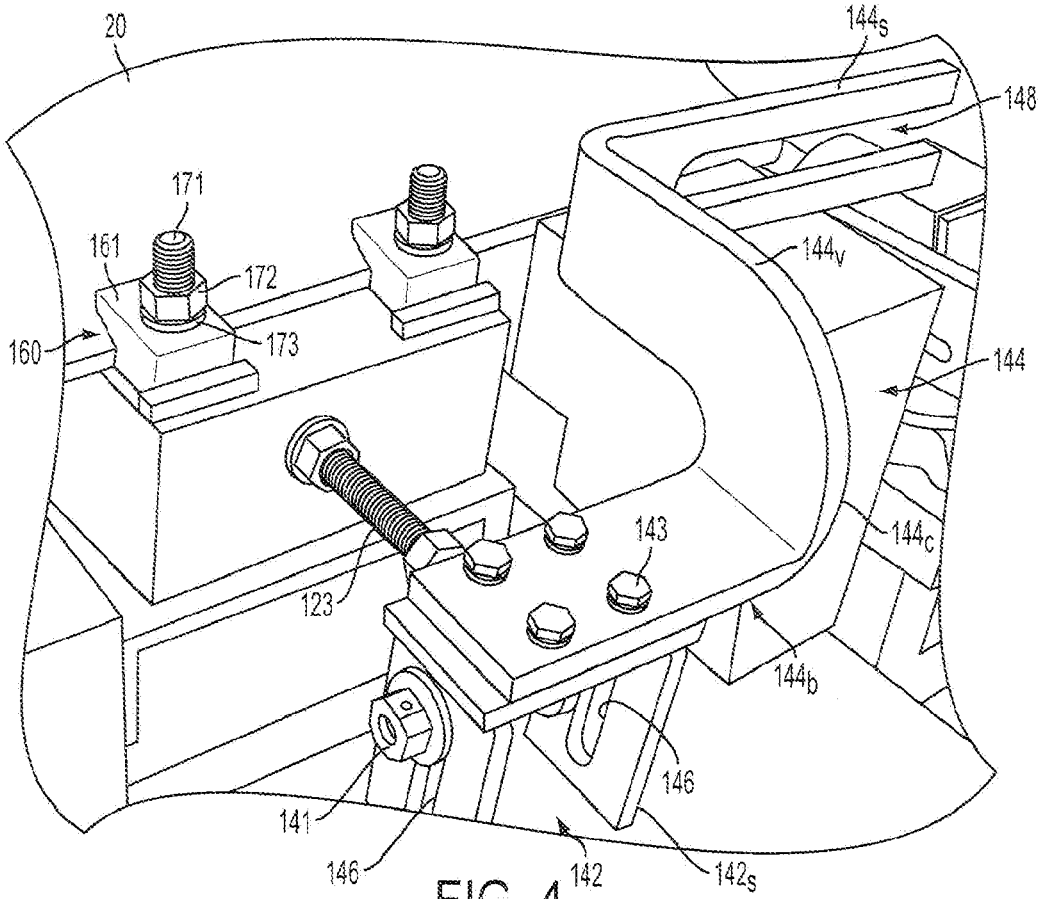
FIG. 4 illustrates details of a point rail connection assembly and stock rail connection assembly constructed in accordance with an embodiment disclosed herein.

Referring to FIG. 4, the point lug assembly 144 is formed from one continuous piece of metal and is bent in two places. In a desired embodiment, the point lug assembly 144 is made of steel. The illustrated point lug assembly 144 includes a horizontal base portion $\mathbf{144}_b$, which bends upwardly (e.g., approximately 90 degrees) into a curved vertical portion $\mathbf{144}_c$. The curved vertical portion $\mathbf{144}_c$ is connected to a vertical wall $\mathbf{144}_v$, which bends to the right (e.g., approximately 90 degrees) into a slotted vertical portion $\mathbf{144}_s$. In the illustrated embodiment, the curved vertical portion $\mathbf{144}_c$ raises the vertical wall $\mathbf{144}_w$ and slotted vertical portion $\mathbf{144}_s$ to a height that provides the proper clearance and positioning for the point rail 30 and its eventual contact with the stock rail 20. it should be appreciated that the angles between the base portion $\mathbf{144}_b$ and curved vertical portion $\mathbf{144}_c$ and the vertical wall $\mathbf{144}_v$ and slotted vertical portion $\mathbf{144}_s$ may vary from the approximate 90 degrees shown in the Figures; all that is required is for the point lug 144 configuration to provide suitable alignment and positioning of the point rail 30 once it is connected as described below.

The base portion $\mathbf{144}_b$ is bolted to the top of the yoke 142 using bolts 143 or any other suitable connecting mechanism. The slotted vertical portion $\mathbf{144}_s$ contains an open ended slot 148 and is used to connect the lug assembly 144 to the point rail 30. For example, as shown in FIGS. 2 and 3, the vertical portion $\mathbf{144}_v$ slides into connectors 32 mounted to the point rail 30. The connectors 32 and the point rail 30 include holes 34 for receiving bolts (not shown) or other appropriate fastening mechanisms that can attach the lug assembly 144 to the point rail 30 in a manner suitable for the railroad environment. As can be appreciated, the open ended slot 148 allows adjustments to be made when the apparatus 100 is installed and/or maintained (i.e., the slot 148 allows for some lateral movement to prevent contact with an adjacent railroad tie 10). In accordance with the disclosed principles, the slots 146 in the yoke 142 and the connection to the swivel eye component 125 allow the point rail 30 and lug assembly 144 to lift and/or bounce without binding the rods of the point machine 120, which is another desirable feature of the apparatus 100 disclosed herein.

As shown in FIG. 6, the point machine housing 124 is attached to a base 110 of the apparatus 100. In one embodiment, the point machine housing 124 and base 110 are made of steel. In another embodiment, the housing 124 could be machined cast iron. It should be noted that with the exception of how the point machine 120 is mechanically connected to the point rail connection assembly 140 and the base 110, the point machine 120 can be any conventional point machine suitable for monitoring and detecting the positioning of the point rail 30. In a desired embodiment, as shown in FIGS. 7 and 8, the housing 124 is bolted to the base 110 from the inside of the housing. Bolts 181 are passed through holes in the housing and screwed into nuts 112 welded to the base 110 (i.e., weld nuts). The bolt 181 can be any threaded fastener suitable for use in the railroad environment. As can be appreciated, this type of connection alleviates the need for connecting hardware on the outside of the housing 124, something that today's point machine apparatuses require. This simplifies installation and the amount of tools required during the installation of the apparatus 100.

In a desired embodiment, the stock rail mount 130 is made of steel and is welded to the base 110. The stock rail mount 130 comprises two walls 131, 133 each being welded at one end to the base 110 and at another end to a platform 135. As best seen in FIG. 6, each wall 131, 133 has a respective cut-out 136, 138 to allow the adjustment rod 123 to pass through the walls 131, 133. Four blocks 132 are welded to the top side of the platform 135. The blocks 132 are sometimes referred to as "kicker" blocks. In addition, the platform 135 includes four holes 139 positioned in the vicinity of the blocks 132.

The holes 139 are adapted to receive bolts 171 such as e.g., square head bolts, used to connect the stock rail connecting assembly 160 to the platform 135 in a manner that maintains the stock rail 20 in place. The stock rail connecting assembly 160 comprises four metal retaining clips 161, one for each hole 139 in the platform 135. As shown in more detail in FIG. 9, a backside 162 of each clip 161 will press against a corresponding kicker block 132 welded to the platform 135 to prevent rotation of the clip 161 when the bolt 171 is received and its corresponding fasteners are tightened from the top side. A front portion 163 of the clip 161 presses down on the stock rail 20 while a bottom portion 164 contacts the platform 135. The clips 161 are bolted in place using externally threaded bolts 171 that in the illustrated embodiment are inserted from under the platform 135, through the platform holes 139, and through holes in the clips 161 (not shown). Locking washers 173 and appropriately sized internally threaded nuts 172 are screwed onto the bolts 171 to maintain the clips 161 in position and to secure the stock rail 20 to the mount 130. It should be appreciated that the illustrated nuts 172, bolts 171 and washers 173 are examples of how the clips 161 can be connected and that the disclosed embodiments can be used with any other suitable device that can hold the clips 161 in place.

As noted above, it is desirable for the apparatus 100 to be generic or common such that it can be used with any size stock rail 20. For example, it is desirable for the apparatus 100 to be used with 5.5 inch base rails and 6 base inch rails (115# to 136# RE) without having to use a different stock rail mount 130 and/or base 110. To accommodate different sized rails 20, the clips 161 disclosed herein can have different sized-front portions 163. Larger clips 161 are used with smaller rails 30 as there will be more space between the rail and the blocks 132. Likewise, smaller clips 161 are used with larger rails 30 as there will be less space between the rail and the blocks 132. That is, for larger rails, the front portions 163 of the clips 161 used to retain the rail will be smaller than the front portions of the clips 161 used with the smaller rails. Since the clips 161 can be changed to fit the size of the rail, the rail mount 130 and the rest of the apparatus 100 can be the same regardless of the rail size. The use of the common mount 130 and apparatus 100 reduces the stocking of finished, dedicated products, which is desirable and not achieved with today's systems. As can be appreciated, stocking difference sized clips 161 is a less costly option than stocking dedicated mounts 130 and/or other larger equipment.

The embodiments disclosed herein provide another advantage over the typical point machine apparatuses in existence today. Because of the way the apparatus 100 is assembled, it is possible to leave a substantial clearance between the top portion of the point machine 120 and the top of the stock rail 20. As shown in FIG. 1, there is a clearance $H_1$ between the top of the lug 126 and the top of the stock rail 20 that, depending upon the rail 20 being used, can be in the range of about 3 to 4 inches. The clearance $H_2$ between the top of the cover 122 and the top of the stock rail 20 can be in the range of about 4 to 5 inches. These clearances are desirable because they prevent the apparatus from being snagged or hit by maintenance equipment, which could damage the apparatus 100 or misalign it.

The foregoing examples are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. A connection assembly adapted to connect a point rail to a shaft of a point machine, said assembly comprising:

a yoke having a top and a pair of sides extending from the top, the sides being spaced apart from each other by a predetermined distance and having a slot; and a point lug assembly having a first end connected to a top surface of the top of the yoke and a second end adapted to be connected to the point rail, wherein the yoke is adapted to receive an end of the shaft within the space between the sides and the slots are adapted to receive a transverse connecting mechanism used to maintain the end of the shaft in a slidable arrangement within the space between the slots.

2. The connection assembly of claim 1, wherein the top and sides of the yoke comprise an inverted U-shape.

3. The connection assembly of claim 2, wherein the point lug assembly is bolted to the top surface of the yoke.

4. The connection assembly of claim 1, wherein the point lug assembly comprises a base portion, a curved portion, a vertical portion and a slotted portion.

5. The connection assembly of claim 4, wherein the base portion is a horizontal base portion, which is connected to the top surface of the yoke, the base portion is connected to a first end of the curved portion, a second end of the curved portion is connected to a first end of the vertical portion and a second end of the vertical portion is connected to a first end of the slotted portion.

6. The connection assembly of claim 5, wherein the slotted portion of the point lug assembly comprises an open ended slot and is adapted to connect to the point rail.

7. The connection assembly of claim 1, wherein a configuration of the yoke and point lug assembly allows the point rail to undergo lift, bounce and run without binding the shaft of the point machine.

8. A point machine apparatus comprising:

a point machine having an adjustment rod; and a connection assembly adapted to connect a point rail to the adjustment rod, said connection assembly comprising:

a yoke having a top and a pair of sides extending from the top, the sides being spaced apart from each other by a predetermined distance and having a slot, and a point lug assembly having a first end connected to a top surface of the top of the yoke and a second end adapted to be connected to the point rail, wherein the yoke is adapted to receive an end of the rod within the space between the sides and the slots are adapted to receive a transverse connecting mechanism used to maintain the end of the rod in a slidable arrangement within the space between the slots.

9. The point machine apparatus of claim 8, wherein the end of the adjustment rod comprises a swivel component and the transverse mechanism is a bolt that fits through the slots and an eye hole in the swivel component.

10. The point machine apparatus of claim 8, wherein the apparatus further comprises a stock rail mount and the point machine and the stock rail mounted are connected to a common base.

11. The point machine apparatus of claim 10, wherein the point machine comprises a housing that is bolted to the base by a plurality of bolts that pass through an interior of the housing and through the base.

12. The point machine apparatus of claim 10, wherein the stock rail mount comprises a horizontal platform and two sides welded between the platform and the base.

13. The point machine apparatus of claim 12, wherein each side of the stock rail mount comprises an opening adapted to allow the shaft of the point machine to pass through the sides of the stock rail mount.

14. The point machine apparatus of claim 12, wherein the stock rail mount platform is adapted to support a portion of a stock rail and a plurality of clips are used to secure the stock rail to the stock rail platform.

15. The point machine apparatus of claim 14, wherein the platform comprises a plurality of blocks and holes, a first portion of each clip abuts one of the blocks, a second portion of each clip abuts the platform, and a third portion of each clip presses on a respective portion of the stock rail when a connection mechanism is inserted through a hole in the clip.

16. The point machine apparatus of claim 15, wherein the third portion of each clip has a size based on a size of the stock rail.

17. The point machine apparatus of claim 8, wherein the top and sides of the yoke comprise an inverted U-shape.

18. The point machine apparatus of claim 17, wherein the point lug assembly is bolted to the top surface of the yoke.

19. The point machine apparatus of claim 8, wherein the point lug assembly comprises a base portion, a curved portion, a vertical portion and a slotted portion.

20. The point machine apparatus of claim 19, wherein the base portion is a horizontal base portion, which is connected to the top surface of the yoke, the base portion is connected to a first end of the curved portion, a second end of the curved portion is connected to a first end of the vertical portion and a second end of the vertical portion is connected to a first end of the slotted portion.

21. The point machine apparatus of claim 20, wherein the slotted portion of the point lug assembly comprises an open ended slot and is adapted to connect to the point rail.

22. The point machine apparatus of claim 8, wherein a configuration of the yoke and point lug assembly allows the point rail to undergo lift, bounce and run without binding the rod of the point machine.

* * * * *